US008837766B2

(12) United States Patent
Liu et al.

(10) Patent No.: US 8,837,766 B2
(45) Date of Patent: Sep. 16, 2014

(54) EAR-LOOP EARPHONE

(75) Inventors: Chun-Hsin Liu, Banciao (TW); Shu-Yuan Cheng, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 287 days.

(21) Appl. No.: 13/445,967

(22) Filed: Apr. 13, 2012

(65) Prior Publication Data

US 2012/0257773 A1 Oct. 11, 2012

Related U.S. Application Data

(63) Continuation-in-part of application No. 11/968,656, filed on Jan. 3, 2008, now abandoned.

(51) Int. Cl.
*H04R 1/10* (2006.01)

(52) U.S. Cl.
CPC ..... *H04R 1/1066* (2013.01)
USPC ..... 381/381

(58) Field of Classification Search
USPC ..... 381/380–381, 370–371, 374, 376, 382, 381/379, 384
See application file for complete search history.

(56) References Cited

U.S. PATENT DOCUMENTS

2005/0277446 A1* 12/2005 Yueh ..... 455/569.1

* cited by examiner

*Primary Examiner* — Hoa B Trinh
(74) *Attorney, Agent, or Firm* — Li&Cai Intellectual Property (USA) Office

(57) ABSTRACT

According to an exemplary embodiment of the present disclosure, the ear-loop earphone comprises a main body, an ear-loop base and an ear-loop. The main body has a surrounding side, a front side, and a back side, wherein the front side is opposing to the back side, the front side has a plurality of sounding apertures for outputting an audio, and the surrounding side surrounds and connects to the front side and the back side. The ear-loop base is fixed on the surrounding side of the main body in a rotatable manner, and rotates with respect to a first axis. The ear-loop is fixed on the ear-loop base in a rotatable manner, and rotates with respect to a second axis different from the first axis.

10 Claims, 9 Drawing Sheets

EAR-LOOP EARPHONE

CROSS-REFERENCE TO RELATED APPLICATION

This is a continuation-in-part application of patent application Ser. No. 11/968,656 filed on Jan. 3, 2008, which claims the priority benefit of Taiwan patent application serial no. 96212958, filed Aug. 7, 2007 and is pending now. The entirety of each of the above-mentioned patent applications is hereby incorporated by reference herein and made a part of this specification.

BACKGROUND

1. Technical Field

The present disclosure relates to an ear-loop earphone, and more particularly, to an ear-loop earphone having an ear-loop base fixed on the surrounding side of a main body of the ear-loop earphone in a rotatable manner, and having an ear-loop fixed on the ear-loop base in a rotatable manner.

2. Description of Related Art

The earphone, a small audio output device, can be used to not disturb others while receiving an audio signal. With the development of new technology, the time that one wears earphones becomes longer. For example, people use earphones to answer the phone while driving or to listen to music while exercising. Thus, whether wearing the earphone is comfortable or not has become important. In general, ear-loop earphones are often used in daily life because wearing an ear-loop earphone is more comfortable.

However, it cannot be adjusted according to the shape and size of a user's ears because the distance is fixed between the main body and the ear-loop of the stereo ear-loop earphone at present. Besides, there are stereo ear-loop earphones with Bluetooth in the market. This kind of earphone has only one earphone with Bluetooth. These earphones with Bluetooth cannot be worn on the other ear (that is, one designed for the right ear cannot be worn on the left, and vice versa) because the ear-loop cannot be adjusted to fit the other ear, and this causes great inconvenience in use.

SUMMARY

It is therefore one of the objectives of the present disclosure to provide an ear-loop earphone in order to solve the above-mentioned problem.

According to an exemplary embodiment of the present disclosure, the ear-loop earphone comprises a main body, an ear-loop base and an ear-loop. The main body has a surrounding side, a front side, and a back side, wherein the front side is opposing to the back side, the front side has a plurality of sounding apertures for outputting an audio, and the surrounding side surrounds and connects to the front side and the back side. The ear-loop base is fixed on the surrounding side of the main body in a rotatable manner, and rotates with respect to a first axis. The ear-loop is fixed on the ear-loop base in a rotatable manner, and rotates with respect to a second axis different from the first axis.

According to an exemplary embodiment of the present disclosure, a stereo earphone apparatus comprising two ear-loop earphones as described above is provided.

To sum up, the ear-loop earphone provided by the exemplary embodiments of the present disclosure can be fitted for the left or right ear by means of easily rotating the ear-loop, which brings great convenience in use.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
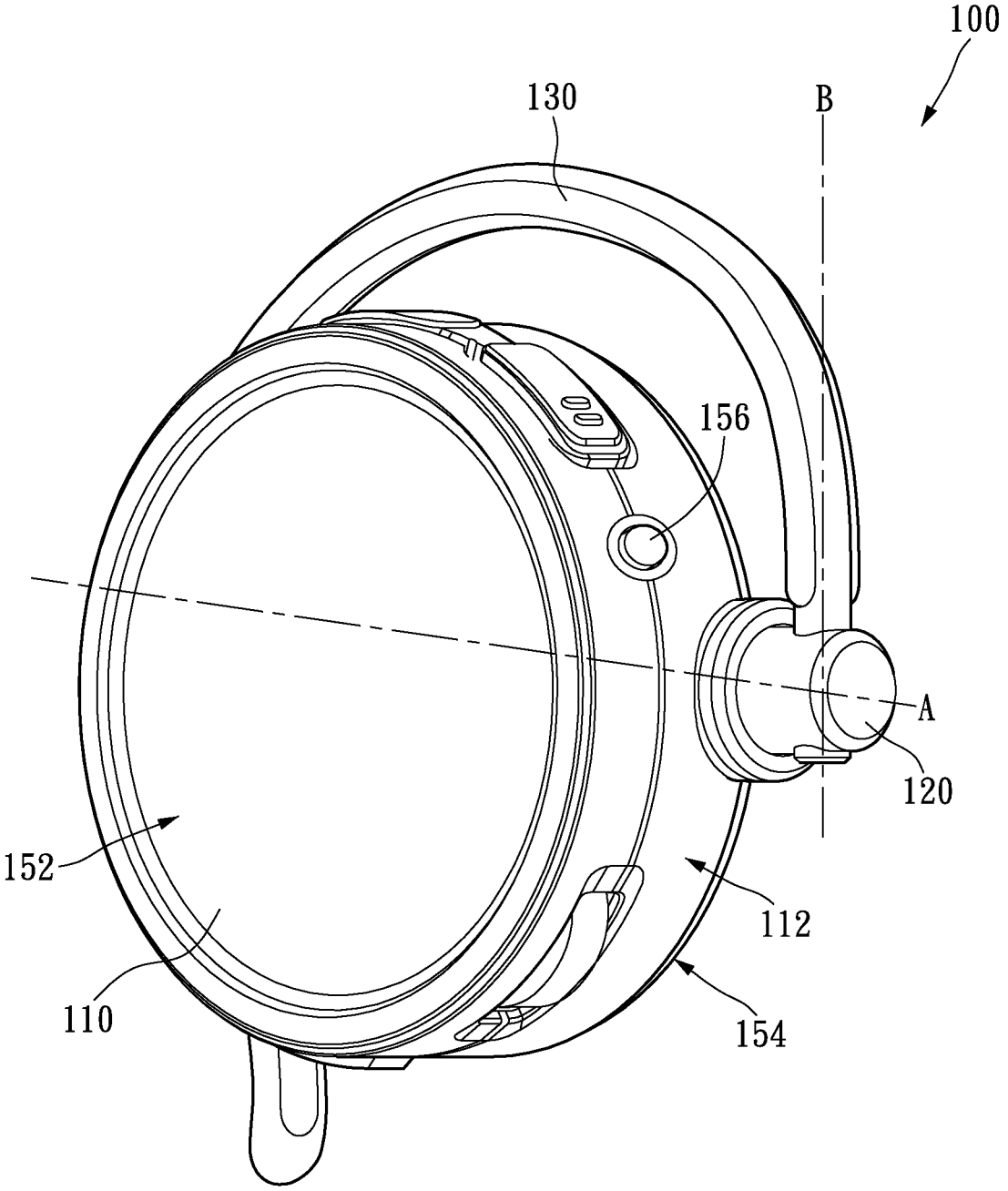
FIG. 1 is a diagram illustrating an ear-loop earphone according to an embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

[An Exemplary Embodiment of the Ear-Loop Earphone]

Referring to FIG. 1, FIG. 1 is a diagram illustrating an ear-loop earphone according to an embodiment of the present disclosure. The ear-loop earphone 100 comprises a main body 110, an ear-loop base 120 and an ear-loop 130. The main body 110 has a surrounding side 112, a back side 152, and a front side 154. The front side 154 is opposing to the back side 152, the front side 154 has a plurality of sounding apertures for outputting an audio (the audio of the right channel, left channel, or mono type), and the surrounding side 112 surrounds and connects to the front side 154 and the back side 152.

The ear-loop base 120 is fixed on the surrounding side 112 of the main body 110 in a rotatable manner, and rotates with respect to a first axis A. The ear-loop 130 is fixed on the ear-loop base 120 in a rotatable manner, and rotates with respect to a second axis B being different from the first axis A.

The main body 110 may further have a detection device (inside the main body 110) connected to the ear-loop base 120 or the ear-loop 130. The detection device detects whether the ear-loop 130 or the ear-loop base 120 is rotated, so as to automatically determine the front side 154 of the main body 110 to output the audio of a left or right channel.

In one implementation, the detection device has a piezoelectric ceramic and a voltage detector inside the main body 110, wherein the piezoelectric ceramic is under stress while the ear-loop 130 or the ear-loop base 120 is rotated. While the piezoelectric ceramic is under stress, the voltage across the piezoelectric ceramic is changes, such that the voltage detector detects the voltage across the piezoelectric ceramic to automatically determine the front side 154 of the main body 110 to output the audio of the left or right channel.

It is noted that the detection device is not the limitation of the present disclosure. In the other implementation, the detection device is replaced by a button 156 on the main body 110, for example on the surrounding side 112. When the button 156 is pressed by the user, the main body 110 automatically determines the front side 154 of the main body 110 to output the audio of a left or right channel.

Please note that the main body 110 has a round shape in the embodiment. However, this is not a limitation of the present disclosure. In other words, the main body 110 can have another shape, such as a square or an ellipse. Thus, the shape of the above-mentioned surrounding side 112 is also not the limitation of the present disclosure. The surrounding side 112 surrounding the back side 152 and front side 154 of the main body 110 with any shape also obeys the spirit of the present disclosure.

Figure 2:
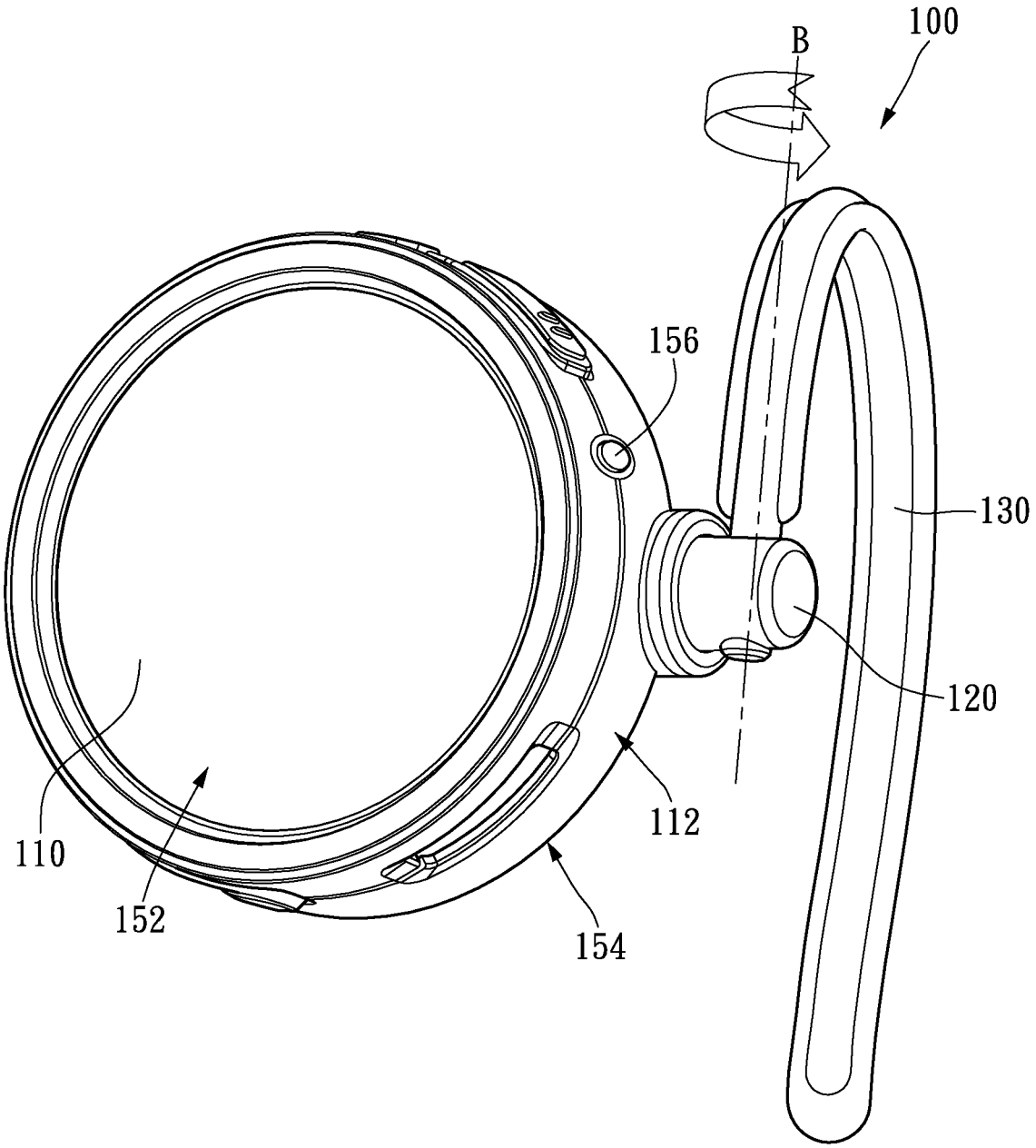
FIG. 2 through FIG. 5 are schematic diagrams illustrating how to change the position of the ear-loop relative to the main body of the ear-loop earphone of the present disclosure.
Figure 3:
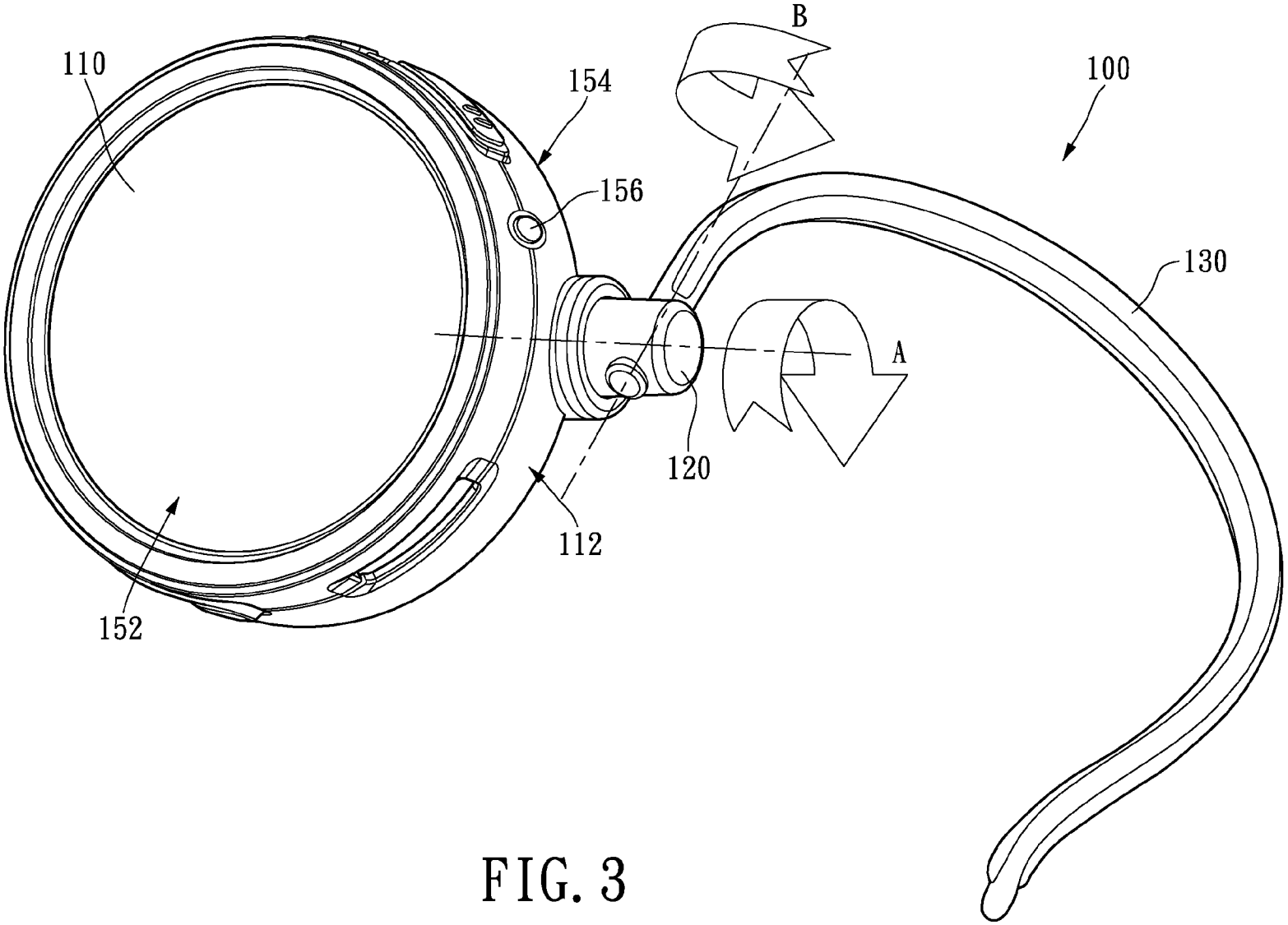
Figure 4:
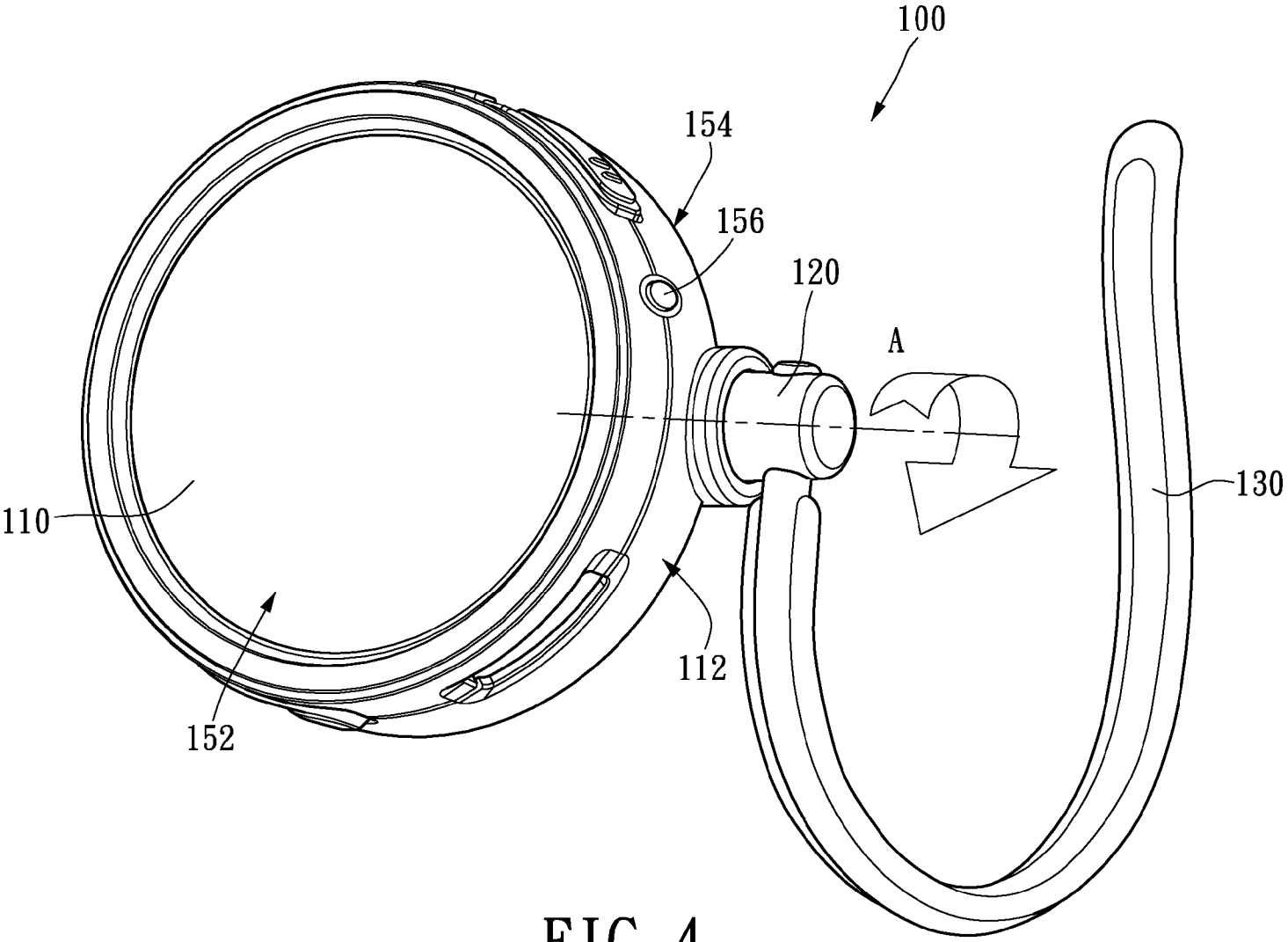
Figure 5:
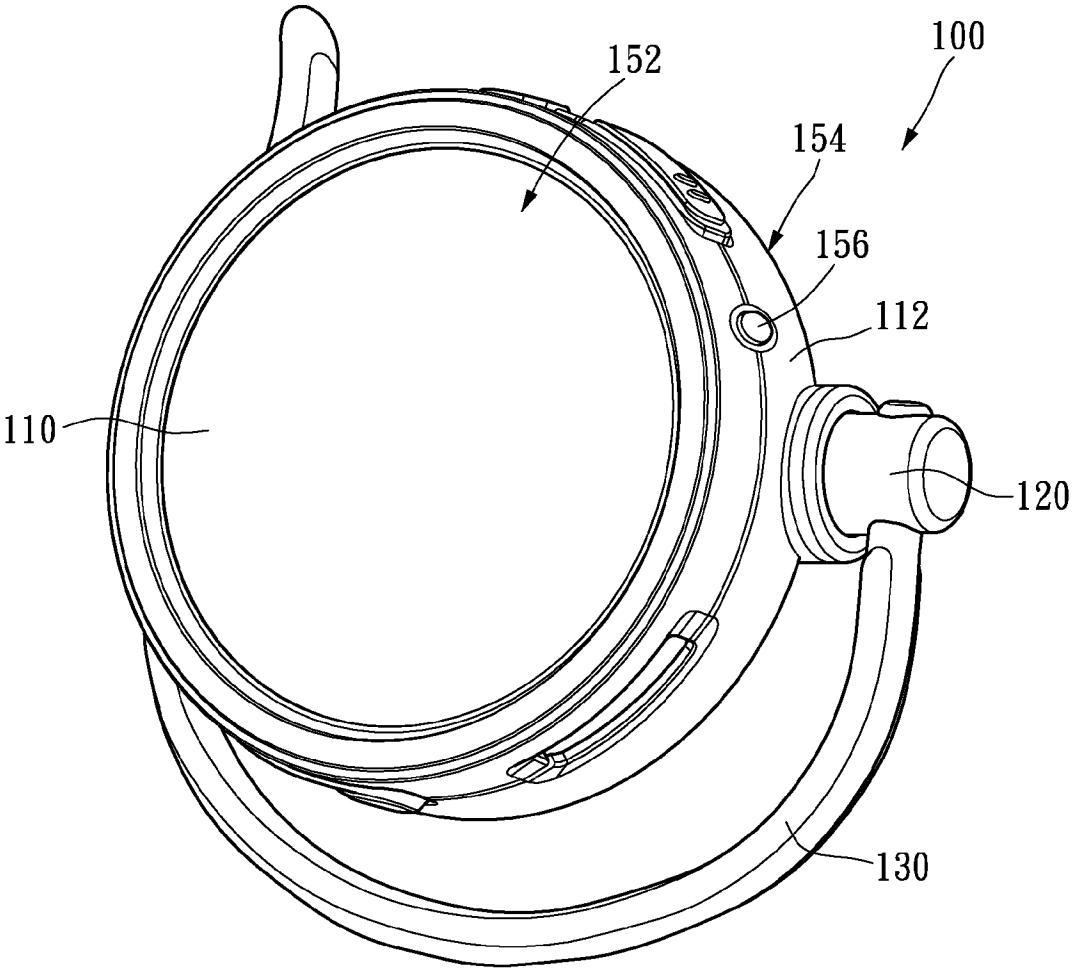

Please refer to FIG. 2 to FIG. 5 and FIG. 1 together, FIG. 2 through FIG. 5 are schematic diagrams illustrating how to change the position of the ear-loop 130 relative to the main body 110 of the ear-loop earphone 100 of the present disclosure, and the steps are illustrated as follows. The structure of the ear-loop earphone 100 as shown in FIG. 1 is for user's right ear. To change the position of the ear-loop 130, so as to fit the ear-loop earphone 100 to the left ear, firstly, as shown in FIG. 2, the ear-loop 130 is rotated some degrees departing from an original position (e.g., the position for user's right ear) with respect to the second axis B. Next, as shown in FIG. 3 and FIG. 4, the ear-loop base 120 is rotated 180 degrees with respect to the first axis A. In the process of rotating the ear-loop base 120, the ear-loop 130 can also be rotated, so as to rotate the ear-loop base 120 more easily. Lastly, as shown in FIG. 5, the ear-loop 130 is rotated to a symmetrical position (e.g., the position for user's left ear) relative to the original position with respect to the second axis B. In this way, the object of changing the position of the ear-loop is achieved. Please note that in this embodiment, rotating the ear-loop base 120 only 180 degrees with respect to the first axis A can achieve the objective of changing the position of the ear-loop. This is not a limitation of the present disclosure. However, as the ear-loop base 120 can be allowed to be rotated 360 degrees with respect to the first axis A.

Please note that if the objective of changing the position of the ear-loop 130 can be achieved, the operation steps are not limited to the order shown in FIG. 1 through FIG. 5. The order of the operation steps are merely for illustrative purposes only and are not meant to be a limitation of the present disclosure.

Moreover, in one implementation, while the ear-loop base 120 is rotated as shown in FIG. 3 or FIG. 4, the detection device inside the main body 110 will determines the front side 154 of the main body 110 outputs the audio of the left channel rather than the audio of the right audio. In another implementation, while the ear-loop 130 is rotated as shown in FIG. 2 or FIG. 3, the detection device inside the main body 110 will determines the front side 154 of the main body 110 outputs the audio of the left channel rather than the audio of the right audio. In another implementation, a button 156 is set on the main body 110, and while the user want to change the ear-loop earphone 100 to be worn on the left ear, the user can press the button 156 to determine the front side 154 of the main body 110 outputs the audio of the left channel rather than the audio of the right audio in after, before, or between the steps of FIG. 2 through FIG. 5.

After reading the above-mentioned description concerning how to switch the position of the ear-loop 130 for a user's left ear from for the user's right ear, a method for modifying the ear-loop earphone 100 should be readily appreciated by those skilled in the art, so further description concerning how to switch the position of the ear-loop 130 for the user's right ear from for use on the left ear is omitted here for the sake of brevity.

Figure 6:
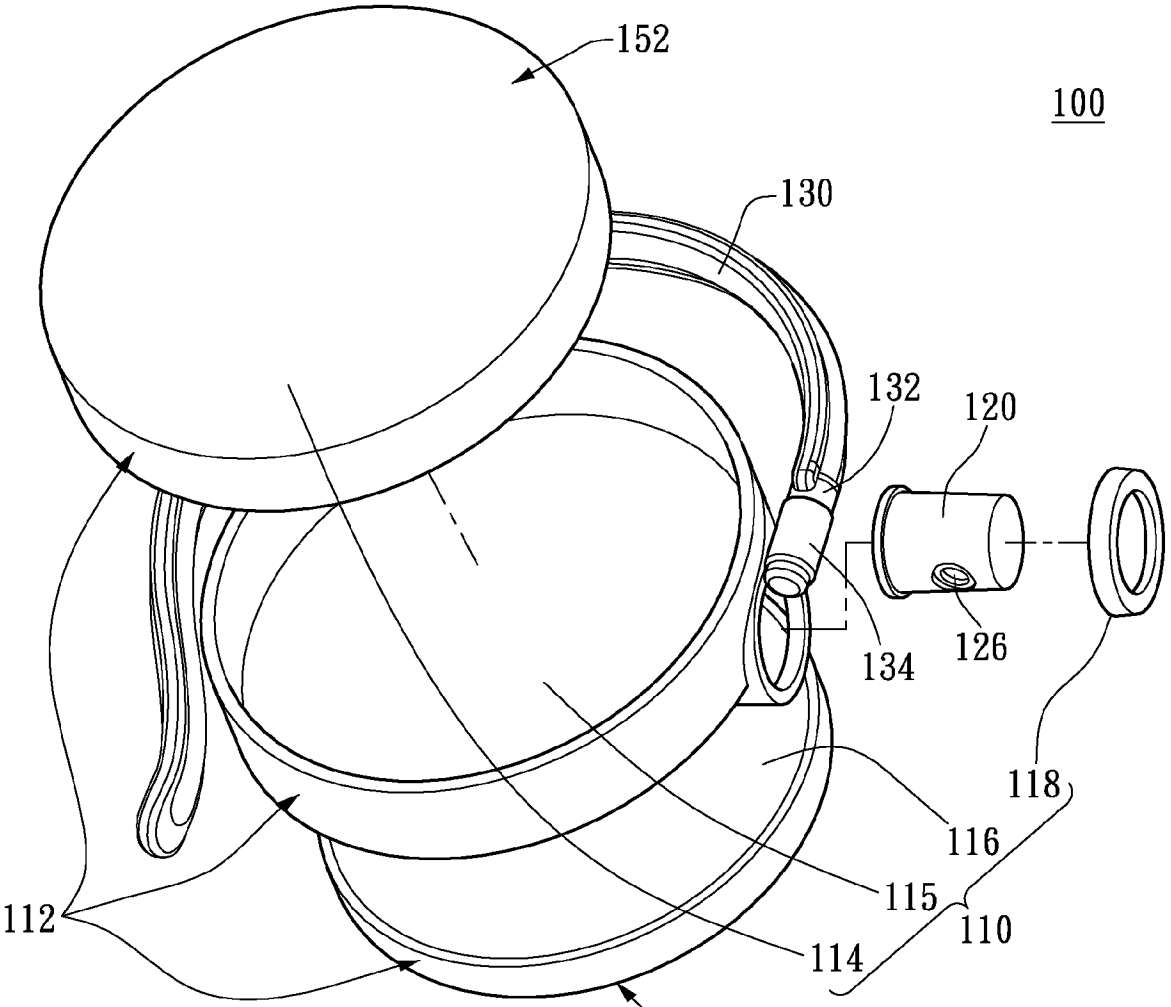
FIG. 6 is a diagram illustrating details of the ear-loop earphone according to the exemplary embodiment of the present disclosure.

Please refer to FIG. 6. FIG. 6 is a schematic diagram illustrating details of the ear-loop earphone 100 according to the first exemplary embodiment of the present disclosure. As shown in FIG. 6, the main body 110 has a first housing 114, a second housing 115, a sponge pad 116 and a base cover 118. The base cover 118 is disposed on the second housing 115. In practice, the base cover 118 can be fixed on the second housing 115 by means of locking with each other, using an ultrasonic wave melting process or adhesive. The ear-loop base 120 has a hole 126.

The ear-loop 130 has a shaft 132 and the shaft 132 is covered with a flexible element 134. In this embodiment, the flexible element 134 is implemented by a rubber ring. However, this is not a limitation of the present disclosure. Furthermore, in this embodiment, the main body 110 has the first housing 114 and the second housing 115. However, this is also not a limitation of the present disclosure. For example, the first housing 114 and second housing 115 can be replaced with a single monolithic housing, and this also obeys the spirit of the present disclosure.

In the embodiment, it is noted that the surrounding side 112 of the main body 110 is formed by the surrounding sides of the first housing 114, the second housing 115, and the sponge pad 116, the back side 152 of the main body 110 is formed by the bottom side of the first housing 114, and the front side 154 of the main body 110 is formed by the bottom side of the sponge pad 116.

Figure 7:
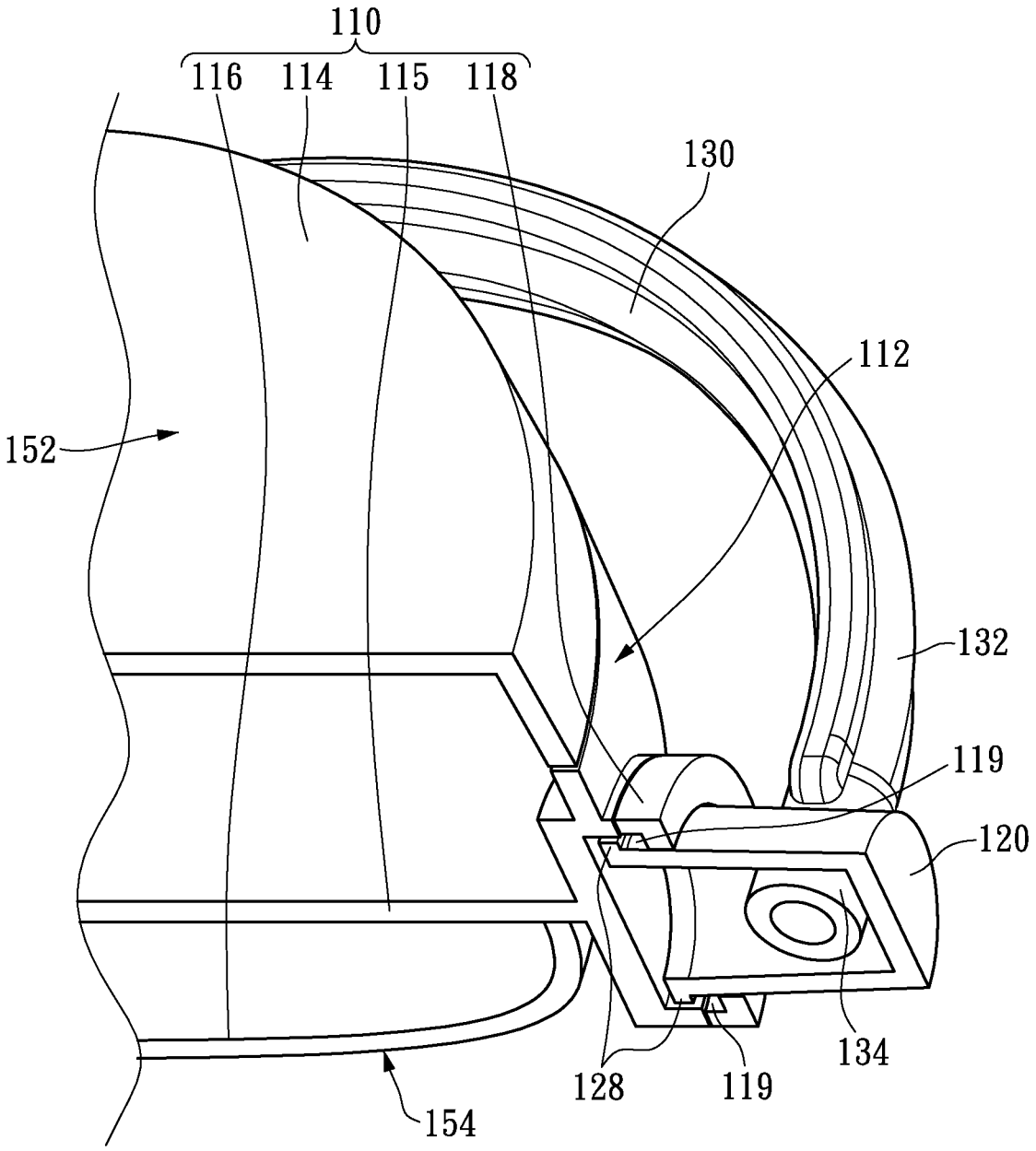
FIG. 7 is a partial perspective cross-sectional diagram illustrating the ear-loop earphone according to the exemplary embodiment of the present disclosure.

Please refer to FIG. 7. FIG. 7 is a partial perspective cross-sectional diagram illustrating the ear-loop earphone 100 according to the first exemplary embodiment of the present disclosure. As shown in FIG. 7, the shaft 132 of the ear-loop 130 passes through the hole 126 (not shown in FIG. 7) of the ear-loop base 120 to fix the ear-loop 130 on the ear-loop base 120 in a rotatable manner. The flexible element 134 (i.e., rubber ring) covering the shaft 132 is utilized for providing the ear-loop base 120 with a contact force to install the shaft 132 in the hole 126 of the ear-loop base 120.

Please refer to FIG. 7 again, the main body 110 has a circular track 119, and the circular track 119 is formed by the second housing 115 and the base cover 118. One end of the ear-loop base 120 has a circular protrusion 128 corresponding to the circular track 119, and the circular protrusion 128 is installed in the circular track 119 to fix the ear-loop base 120 in the main body 110 in a rotatable manner.

[Another Exemplary Embodiment of the Ear-Loop Earphone]

Please note that the structure of the ear-loop earphone mentioned in the above embodiment is for illustrative purposes only, and it is not a limitation of the present disclosure. That is to say, in other embodiments, the ear-loop earphone can have a different structure depending on design requirements.

Figure 8:
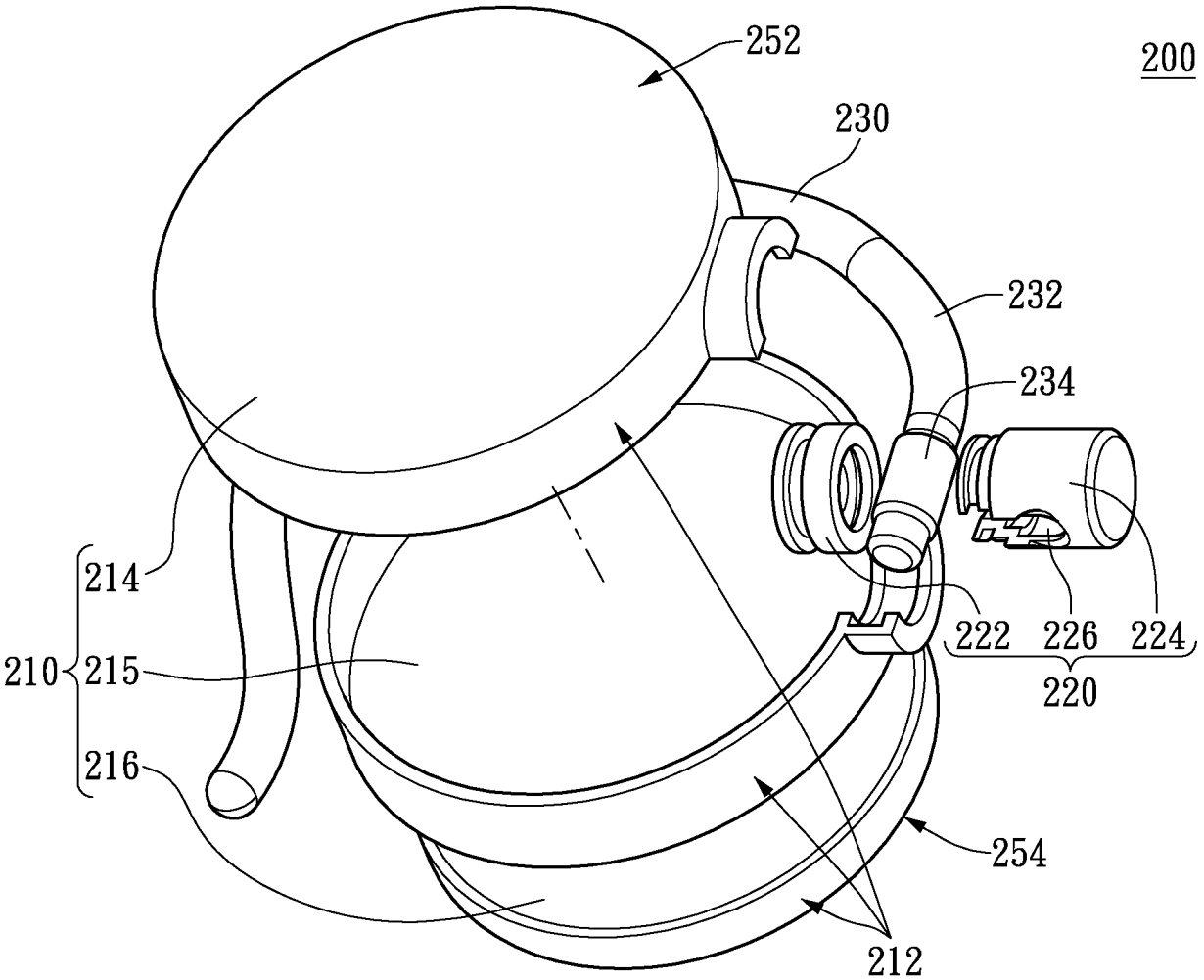
FIG. 8 is a schematic diagram illustrating an ear-loop earphone according to another exemplary embodiment of the present disclosure.

Please refer to FIG. 8. FIG. 8 is a schematic diagram illustrating an ear-loop earphone 200 according to another exemplary embodiment of the present disclosure. As shown in FIG. 8, a main body 210 of the ear-loop earphone 200 has a first housing 214, a second housing 215 and a sponge pad 216. An ear-loop base 220 has a first pivot element 222 and a second pivot element 224, and the second pivot element 224 has a hole 226. An ear-loop 230 has a shaft 232 and the shaft 232 is covered with a flexible element 234. In this embodiment, the flexible element 234 is implemented by a rubber ring.

In the embodiment, it is noted that the surrounding side 212 of the main body 210 is formed by the surrounding sides of the first housing 214, the second housing 215, and the sponge pad 216, the back side 252 of the main body 210 is formed by the bottom side of the first housing 214, and the front side 254 of the main body 210 is formed by the bottom side of the sponge pad 216.

Figure 9:
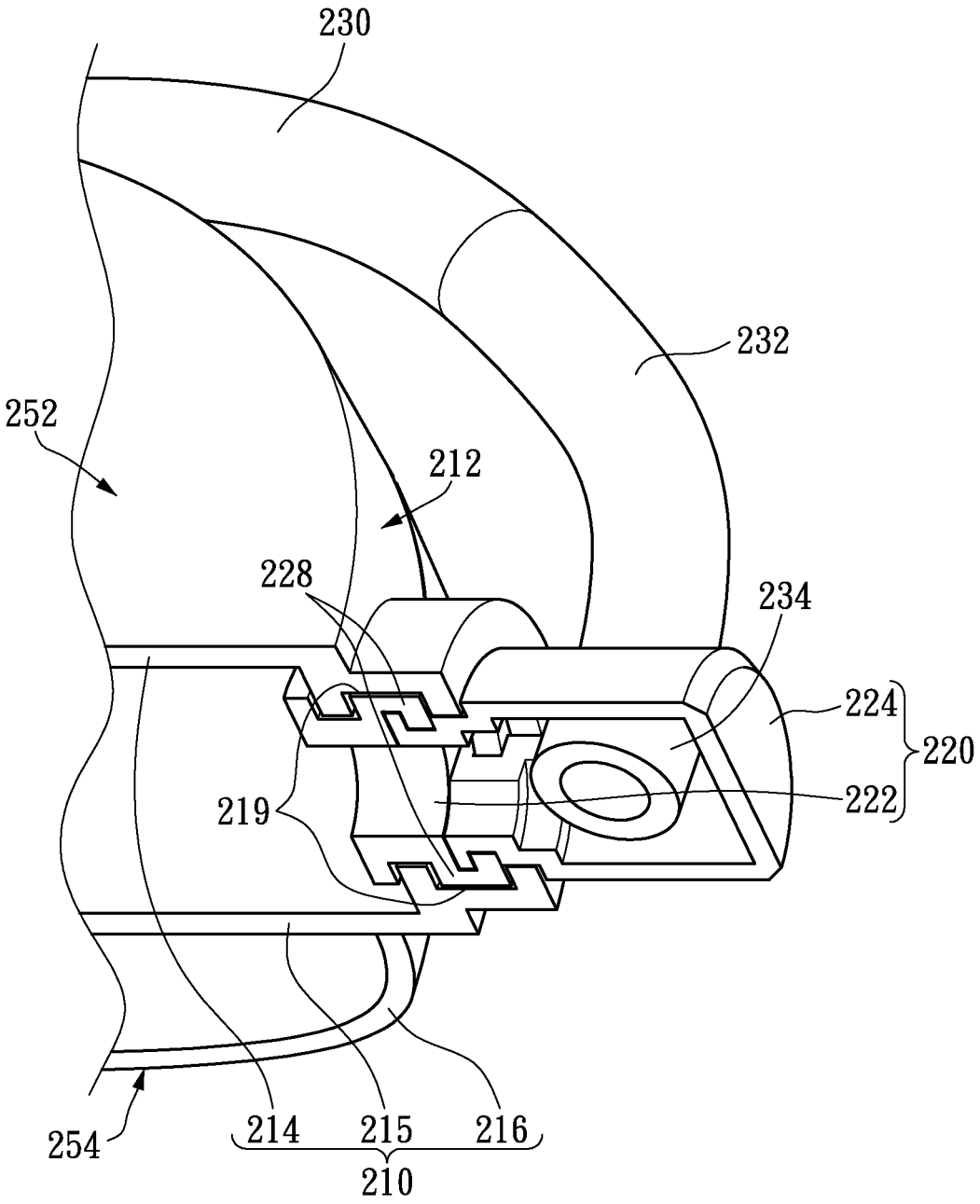
FIG. 9 is a partial perspective cross-sectional diagram illustrating the ear-loop earphone according to the other embodiment of the present disclosure.

Please refer to FIG. 9. FIG. 9 is a partial perspective cross-sectional diagram illustrating the ear-loop earphone 200 according to the other exemplary embodiment of the present disclosure. As shown in FIG. 9, the ear-loop base 220 is formed by the first pivot element 222 and the second pivot element 224. The shaft 232 passes through the hole 226 (not shown in FIG. 9) of the second pivot element 224 in order to fix the ear-loop 230 on the ear-loop base 220 in a rotatable manner. The flexible element 234 (i.e., rubber ring) covering the shaft 232 is utilized for providing the ear-loop base 220 with a contact force to install the shaft 232 in the hole 226 of the second pivot element 224. Please note that the material of the flexible element 234 is rubber, but this is not a limitation of the present disclosure.

Please refer to FIG. 9 again, the main body 210 has a circular track 219, and the circular track 219 is formed by the first housing 214 and the second housing 215. One end of the ear-loop base 220 has a circular protrusion 228 corresponding to the circular track 219, and the circular protrusion 228 is disposed on the first pivot element 222. The circular protrusion 228 is installed in the circular track 219 to fix the ear-loop base 220 in the main body 210 in a rotatable manner.

Since the method for using the ear-loop earphone 200 is similar to that for using the ear-loop earphone 100, after reading the above-mentioned description concerning how to switch the position of the ear-loop 130 of the ear-loop earphone 100, a corresponding method for switching the position of the ear-loop 230 of the ear-loop earphone 200 should be readily appreciated by those skilled in the art, so further description concerning the method for using the ear-loop earphone 200 is omitted here.

[An Exemplary Embodiment of the Stereo Earphone Apparatus]

Please note that a stereo earphone apparatus can comprise the ear-loop earphone of the present disclosure. For example, the stereo earphone apparatus is a Bluetooth stereo earphone apparatus, wherein one earphone with Bluetooth function can be used as a hands-free receiver, and another earphone does not have Bluetooth function. The position of the ear-loop of the earphone with Bluetooth function can be adjusted depending on the user's preference in order to fit the user's right or left ear when being used as a hands-free receiver.

If the side of the earphone without Bluetooth function is for use on the left (or right) ear, the ear-loop of the other side of the earphone (the side with Bluetooth) can be adjusted to a normal position for the right (or left) ear to allow the stereo earphone apparatus to be used as stereo earphones. However, this is not a limitation of the present disclosure. For example, two the earphones are both the ear-loop earphones of the present disclosure, and this also obeys the spirit of the present disclosure.

[Possible Advantages of the Exemplary Embodiments of the Ear-Loop Earphone and Stereo Earphone Apparatus]

Compared to the prior art, the ear-loop earphone of the present disclosure can be fitted for the left or right ear by means of easily rotating the ear-loop. Furthermore, the distance between the main body and the ear-loop can be adjusted according to the shape and size of user's ear between the earphone and the ear-loop in order to increase the comfort while wearing the earphone.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

What is claimed is:

1. An ear-loop earphone, comprising:

a main body, having a surrounding side, a back side, and a front side, wherein the back side is opposing to the front side, the front side has a plurality of apertures for outputting an audio, and the surrounding side surrounds the front side and the back side;

an ear-loop base, fixed on the surrounding side of the main body in a rotatable manner, wherein the ear-loop base rotates with respect to a first axis; and an ear-loop, fixed on the ear-loop base in a rotatable manner, wherein the ear-loop rotates with respect to a second axis different from the first axis;

wherein the main body further has a detection device connected to the ear-loop base or the ear-loop, the detection device detects whether the ear-loop or the ear-loop base is rotated, so as to automatically determine the front side of the main body to output the audio of a left or right channel;

wherein the detection device has a piezoelectric ceramic and a voltage detector, wherein the piezoelectric ceramic is under stress while the ear-loop or the ear-loop base is rotated, while the piezoelectric ceramic is under stress, the voltage across the piezoelectric ceramic is changes, such that the voltage detector detects the voltage across the piezoelectric ceramic to automatically determine the front side of the main body to output the audio of a left or right channel.

2. The ear-loop earphone of claim 1, wherein the ear-loop base has a hole and the ear-loop has a shaft, and the shaft passes through the hole to fix the ear-loop in the ear-loop base in a rotatable manner.

3. The ear-loop earphone of claim 2, wherein the shaft is covered with a flexible element, which is utilized for exerting a contact force upon the ear-loop base to install the shaft in the hole of the ear-loop base.

4. The ear-loop earphone of claim 1, wherein the main body has a circular track and one end of the ear-loop base has a circular protrusion corresponding to the circular track, and the circular protrusion is installed in the circular track to fix the ear-loop base in the main body in a rotatable manner.

5. The ear-loop earphone of claim 4, wherein the main body has a first housing and a second housing, and the circular track is formed by the first housing and the second housing.

6. The ear-loop earphone of claim 4, wherein the main body has a housing and a base cover which is disposed on the housing, and the circular track is formed by the housing and the base cover.

7. The ear-loop earphone of claim 4, wherein the ear-loop base comprises:

a first pivot element, having the circular protrusion; and a second pivot element;

wherein the circular protrusion is installed in the circular track to fix the ear-loop base in the main body in a rotatable manner.

8. The ear-loop earphone of claim 7, wherein the second pivot element has a hole and the ear-loop has a shaft, and the shaft is through the hole to fix the ear-loop in the ear-loop base in a rotatable manner.

9. The ear-loop earphone of claim 1, wherein the main body has a button, when the button is pressed, the main body automatically determines the front side of the main body to output the audio of a left or right channel.

10. A stereo earphone apparatus, comprising at least the ear-loop earphone of claim 1.

* * * * *